United States Patent [19]

Kurtz

[11] 4,394,000

[45] Jul. 19, 1983

[54] METAL MIRROR MOUNTING CLIP

[76] Inventor: Thomas D. Kurtz, 1101 First Ave., Rock Falls, Ill. 61071

[21] Appl. No.: 222,122

[22] Filed: Jan. 2, 1981

[51] Int. Cl.[3] ..... A47G 1/16

[52] U.S. Cl. ..... 248/466; 248/488

[58] Field of Search ..... 248/466, 480, 475 R, 248/490, 491, 488, 201, 316 A, 544, 226.5

[56] References Cited

U.S. PATENT DOCUMENTS

| | | | |
|---|---|---|---|
| 1,212,185 | 1/1917 | Cobb . | |
| 1,439,351 | 7/1919 | Alsip et al. | 248/226.5 X |
| 1,540,394 | 6/1925 | Hall et al. | 248/226.5 X |
| 1,856,923 | 5/1932 | Miller | 248/466 |
| 2,053,124 | 9/1936 | Banks | 248/488 |
| 2,532,162 | 11/1950 | Goss | 248/488 X |
| 2,600,917 | 6/1952 | Petersen | 248/201 X |
| 2,782,686 | 2/1957 | Rothgart et al. | 248/480 X |
| 3,237,898 | 3/1966 | Goss | 248/488 X |
| 3,350,045 | 10/1967 | Mayers | 248/475 R X |

FOREIGN PATENT DOCUMENTS

| | | | |
|---|---|---|---|
| 514052 | 6/1955 | Canada | 248/490 |
| 635806 | 4/1950 | United Kingdom | 248/490 |

OTHER PUBLICATIONS

SOMACA 1974 Supply Catalog, p. 176, items Stock Nos. 306-1501; 305-2631.

SOMACA Glass Shop Supply Catalog, p. 163, Stock Nos. 306-1318; 306-1774; 306-1778 and 306-1060.

*Primary Examiner*—William H. Schultz

*Assistant Examiner*—Ramon O. Ramirez

*Attorney, Agent, or Firm*—Vernon J. Pillote

[57] ABSTRACT

A metal mirror mounting clip of the type having a back plate, a forwardly extending flange on one end of the back plate and lip on the forward edge of the flange. The back plate has a slot for receiving a headed mounting screw and a pair of integral mirror guide shoes spaced from opposite sides of the slot and defining guide surfaces spaced forwardly from the back plate a distance greater than the height of the head of the screw.

4 Claims, 5 Drawing Figures

Fig. 1.
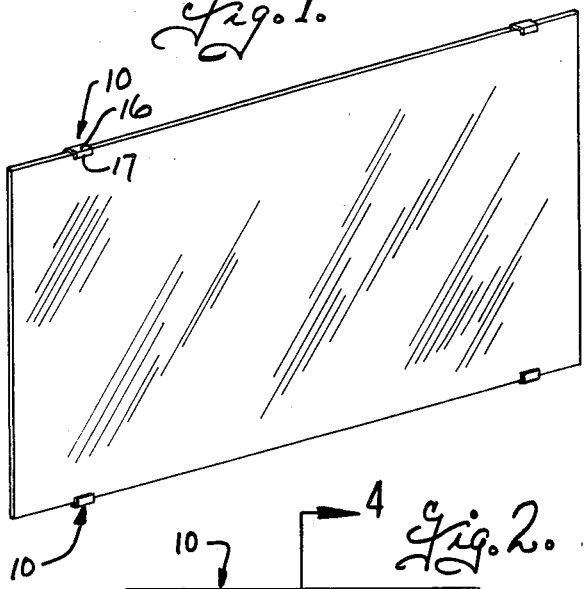
Fig. 4.
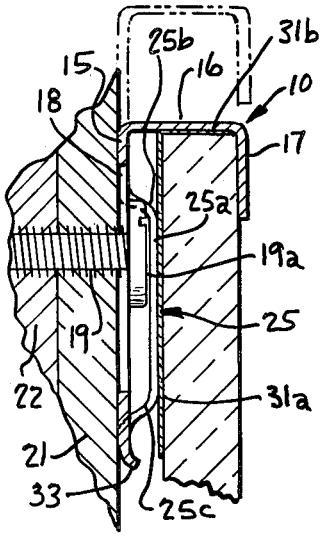
Fig. 2.
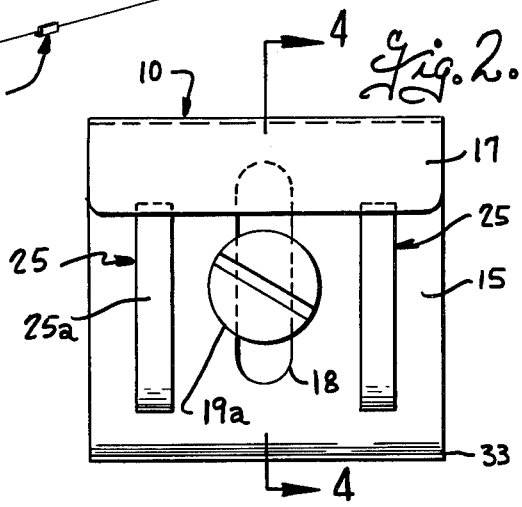
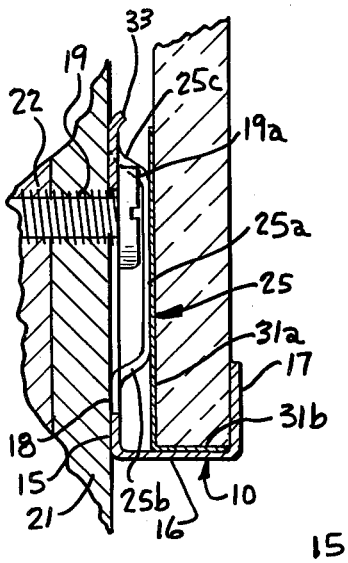
Fig. 5.
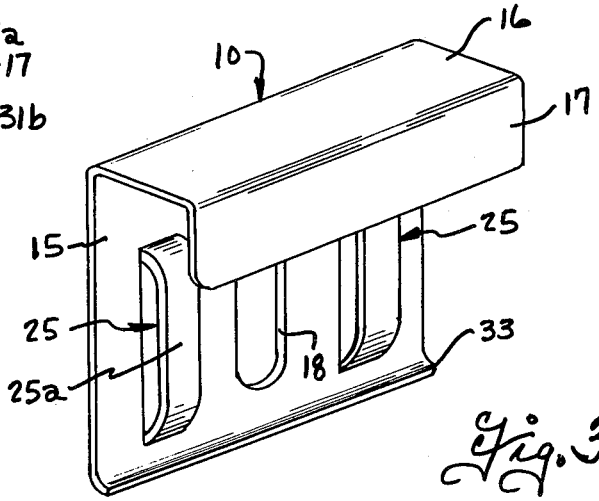
Fig. 3.

METAL MIRROR MOUNTING CLIP

BACKGROUND OF THE INVENTION

The present invention relates to one-piece metal mounting clips of the type having a backing plate, a flange at one edge and a lip on the flange for retaining the mirror on the clip, and which are adapted to be mounted directly to the wall surface by a headed mounting screw extending through a slot in the back plate. When such one-piece metal clips are mounted on a wall, the head of the screw overlies the front face of the back plate and problems have been encountered in chipping of the mirror edges and scratching of the mirror backing on the head of the mounting screw during installation of the mirror, even when a protective pad of fiber, sponge rubber or the like is provided between the mirror and the back plate.

SUMMARY OF THE INVENTION

It is an object of the present invention to overcome the problems of chipping and scratching of the mirror on the head of the mounting screw encountered in prior one-piece metal mirror mounting clips, by forming the back plate of the metal clip with integral guide shoes to space the back of the mirror from the head of the mounting screw.

Another object of this invention is to provide a mirror mounting clip having an improved construction which facilitates movement of the mirror mounting clips into mirror engaging position after the mirror has been installed.

Accordingly, the present invention provides a metal mirror mounting clip comprising a back plate having an integral flange on one edge extending forwardly from the front side of the back plate and an integral lip on the flange spaced laterally from the forward side of the back plate, the back plate having an elongated slot extending perpendicular to the flange for receiving a headed mounting screw, and the back plate having a pair of mirror guide shoes integral therewith generally paralleling the slot and spaced from opposite sides of the slot, the guide shoes defining guide surfaces spaced forwardly from the front side of the back plate a distance greater than the height of the head of the mounting screw to space the back of the mirror from the screw head.

The back plate of the mirror mounting clip can advantageously be provided with a lip on the edge opposite the flange which lip is curved forwardly to facilitate guiding the mirror clip over the wall surface during adjustment of the clip.

These, together with other objects, features and advantages of this invention will be more readily understood by reference to the following detailed description when taken in connection with the accompanying drawings wherein:

FIG. 1 is a perspective view illustrating a mirror attached to a wall by means of a plurality of mirror mounting clips;

FIG. 2 is a front elevational view of the mirror mounting clip embodying the present invention;

FIG. 3 is a perspective view of the mirror mounting clips;

FIG. 4 is a vertical sectional view taken on the plane 4—4 of FIG. 2 and illustrating the mirror mounting clip installed on a wall for supporting the upper edge of the mirror;

FIG. 5 is a vertical sectional view through the mirror mounting clip illustrating the mirror mounting clip mounted on a wall for supporting the lower edge of the mirror.

The mirror clips 10 of the present invention are adapted for use on all edges of a mirror and, as shown in FIG. 1, two or more mirror clips 10 are provided the lower edge of the mirror and two or more mirror mounting clips at the upper edge. In addition, the same clips 10 could be utilized for the side edges of the mirror, if desired.

The mirror mounting clips 10 comprise a one-piece metal clip having a back plate 15, an integral flange 16 on one edge of the back plate and extending forwardly from the front side of the back plate to engage an edge of the mirror, and an integral lip 17 on the forward edge of the flange spaced from the forward side of the back plate a distance substantially greater than the thickness of the mirror to engage the front side of the mirror. The back plate 15 is provided with an elongated slot 18 that extends perpendicular to the flange 16 and which is adapted to receive a headed mirror mounting screw 19. The screw 19 is preferably of the pan-head type in which the head **19*a* has a flat underside adapted to overlie the front face of the back plate. The screw is selected to have a length, for example one inch which is sufficient to extend through the plaster or dry wall 21 and into a wall stud 22**.

In accordance with the present invention, the back plate is formed with a pair of mirror guide shoes 25 that are integral with the back plate and extend generally parallel to the slot 18 at locations spaced from opposite sides of the slot. The guide shoes are preferably formed by shearing an elongated strip along its lengthwise edges from the back plate at a location intermediate the edges of the back plate, and deforming the sheared strip to provide an elongated generally straight guide portion **25*a* that is integrally connected by curved end portions 25*b* and 25*c* to the back plate. The generally straight guide portion 25*a* provides a guide surface at its forward side that is spaced from the front face of the back plate a distance greater than the thickness of the head 19*a* of the mounting screw, to space the rear of the mirror from the head of the mounting screw. A protective pad is preferably provided to protect the edge and back portions of the mirror that contacts the metal mounting clip. As shown in FIGS. 4 and 5, the pad includes a back portion 31*a* that overlies the faces on the mirror guide shoes 25, and a flange portion 31*b* that overlies the inner face of the flange 16 on the mirror clip. The pad may be formed from plastic sheet or plastic coated fiber stock and is preferably provided with a coating of pressure sensitive adhesive on the faces of the pads that contact the guide shoes and flange on the clip, to hold the protective pad in position during installation of the mirror. As will be readily apparent, the pad can be precoated with a pressure sensitive adhesive and the adhesive protected by a peelable cover sheet (not shown) that can be stripped off when installing the protective pad. As will be seen from FIGS. 4 and 5, the lip 17 on the clip is faced forwardly from the front faces of the guide shoes 25 a distance slightly greater than the thickness of the mirror to accommodate the back portion of the protective pad 31**.

When installing the mirror, the brackets 10 that are utilized for supporting the lower edge of the mirror are preferably mounted as shown in FIG. 5 with the screw located adjacent the upper edge of the slot 18, so that the shank of the screw directly engages and supports the mounting clip and the mirror carried thereby. The clips 10 utilized for mounting the upper edge of the mirror are initially mounted so that the screw extends through the slot adjacent its lower edge when the mounting plate is in a raised position as shown in phantom in FIG. 4, with the lip 17 at a level spaced above the flange on the lower mirror mounting clips a distance greater than the height of the mirror. When the mirror is thereafter installed, the upper mirror mounting clip is forced downwardly as by gentle tapping with a hammer or the like until the flange on the upper mirror mounting clips engages the upper edge of the mirror.

In order to facilitate movement of the mirror mounting clips along the wall surface without digging into the wall surface during adjustment of the clips, the back plate is formed with a forwardly curved lip 33 on the edge opposite the edge from which the flange 16 extends. The lip 33 curves forwardly from the back plate a distance less than the spacing of the mirror guide 25 from the back plate, so that the mirror guides 25 also support the back of the mirror in spaced relation to the lip 33 on the respective mirror mounting clip.

From the foregoing it is thought that the construction and use of the metal mirror mounting clips will be readily understood. As previously described, the same clips can be utilized on all edges of the mirror including the bottom, top and side edges. When used for supporting the bottom edge of the mirror, the screw is preferably located adjacent the upper end of the slots so that the back plate rests on the shank of mounting screw to be directly supported thereby. When used on the upper or side edges of the mirror, the mirror mounting clips allow limited adjustability in a direction paralleling the plane of the support surface. Thus, the clips for the upper edge of the mirror can be moved to a raised position spaced from the lower mirror mounting brackets a distance greater than the height of the mirror and then forced downwardly after the mirror has been positioned on the mirror mounting brackets. The guide shoes space the rear side of the mirror from the back plate a distance greater than the height of the head of the mounting screw to maintain the rear side of the mirror spaced from the screw head during installation of the mirror. The mounting clips can be formed of any suitable metal such as stainless steel or steel and can be plated and finished in any desired manner.

The embodiments of the invention in which an exclusive property or privilege is claimed are defined as follows:

1. A metal mirror mounting clip comprising, a back plate having an integral flange on one edge extending forwardly from the front side of the back plate and an integral lip on the flange spaced forwardly from the forward side of the back plate, a mounting screw having a head and a threaded shank, the back plate having an elongated slot extending perpendicular to the flange for receiving the shank of the headed mounting screw, the back plate having a pair of mirror guide shoes integral therewith generally paralleling the slot and spaced from opposite sides of the slot, said mirror guide shoes each comprising an elongated strip sheared along its lengthwise edges from the back plate and having an elongated generally straight portion offset forwardly from the front side of the back plate and rearwardly curved end portions at opposite ends of the straight portion integral with the back plate, the guide shoes defining guide surfaces spaced forwardly from the front side of the back plate a distance greater than the height of the head of the mounting screw.

2. A metal mirror mounting clip according to claim 1 including a protective pad having a back portion for engaging the faces of the mirror guide shoes and a flange portion for engaging the inner face of the flange on the mirror clip.

3. A metal mirror mounting clip according to claim 1 wherein the back plate has a forwardly curved lip on the edge opposite said one edge; said forwardly curved lip extending forwardly of the back plate a distance less than the spacing of the guide surfaces from the front side of the back plate.

4. A metal mirror mounting clip according to claim 1 wherein the back plate has a forwardly curved lip on the edge opposite said one edge; said forwardly curved lip extending forwardly of the back plate a distance less than the spacing of the guide surfaces from the front side of the back plate.

* * * * *